US006309061B1

(12) United States Patent
Stolk et al.

(10) Patent No.: US 6,309,061 B1
(45) **Date of Patent: *Oct. 30, 2001**

(54) INK JET ARRAY

(75) Inventors: Hendrik Jan Stolk, Bergen; Peter Joseph Hollands, Baarlo; Wilhelmus Theodorus Johannes Brugman, Venlo, all of (NL)

(73) Assignee: Océ-Technologies B.V., Venlo (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/481,393

(22) Filed: Jan. 12, 2000

(30) Foreign Application Priority Data

Jan. 25, 1999 (NL) ..... 1011127

(51) Int. Cl.[7] ..... B41J 2/175
(52) U.S. Cl. ..... 347/93
(58) Field of Search ..... 347/93, 68, 20, 347/84, 92, 85, 86

(56) References Cited

U.S. PATENT DOCUMENTS 4,364,067 12/1982 Koto et al. .
4,514,743 4/1985 Roschlein et al. .
4,689,641 * 8/1987 Scardovi et al. ..... 347/92

FOREIGN PATENT DOCUMENTS

A10867289 9/1998 (EP) .
60-198255-A * 10/1985 (JP) ..... 347/93
63-260447-A * 10/1988 (JP) ..... 347/93
4-99634 * 3/1992 (JP) .

OTHER PUBLICATIONS

Patent Abstracts of Japan, JP 04 099634 A (Seikosha Co Ltd), Mar. 31, 1992.
Patent Abstracts of Japan, JP 59 167267 A (Nippon Denki KK), Sep. 20, 1984.
Patent Abstracts of Japan, JP 01 186331 A (Ricoh Co Ltd) Jul. 25, 1989.

* cited by examiner

*Primary Examiner*—Judy Nguyen
(74) *Attorney, Agent, or Firm*—Birch, Stewart, Kolasch & Birch, LLP

(57) ABSTRACT

A device for delivering ink to a substrate including a body member, an ink distribution chamber, a plurality of ink delivery nozzles, a plurality of ink passages formed in a side body member for delivering the ink from the ink distribution chamber to the ink delivery nozzles, the ink passages being formed, at least partially, as grooves in said side of the body member, and a filter element for filtering the ink entering the ink passages, said filter element being disposed on said side of the body member covering the grooves.

7 Claims, 2 Drawing Sheets

INK JET ARRAY

BACKGROUND OF THE INVENTION

The present invention relates to a device for delivering ink, more particularly on a print head for an ink jet printer, provided with a series of ink delivery nozzles which can be actuated selectively in the printing of a sheet of paper or the like. The present invention also relates to an ink jet printer provided with such a device.

A known printer head is provided with a base body or base plate with two flat sides and a head surface, and a series of parallel ink ducts provided in each side and merging near the corner to the head surface into ink tunnels which extend through the base body to the head surface. The ink ducts originate from an ink distribution chamber provided in the associated side and connected via an internal passage to the ink inlet provided in the body. To prevent any irregularities from occurring in the ink ducts and then obstructing the throughflow, a filter is provided in the distribution chamber at the downstream end of the passage between the inlet and the distribution chamber. This filter is placed in the distribution chamber from the exterior, after which a foil is placed over the ink ducts and over the distribution chamber.

One disadvantage of this arrangement is that air bubbles liberated in the distribution chamber can readily enter the ink passages and in the long term may interfere with the ink delivery in the associated ink passages. If the filter becomes clogged, ink may be withdrawn from a neighbouring duct.

SUMMARY OF THE INVENTION

The object of the present invention is to provide an improvement in this respect. To this end, according to one aspect of the invention, there is provided a device for delivering ink to a sheet of paper or the like, comprising a body with sides and a head end disposed at an angle to the sides and containing an inlet for the ink originating from a reservoir. A plurality of ink delivery nozzles are provided at the head end and a plurality of ink passages extend between the inlet and the ink delivery nozzles, along one or more of the sides, with means located at the ink passages on that side for the selective propulsion of ink therethrough to the ink delivery nozzles. Filter means are provided between the reservoir and the ink passages and are disposed in a distribution chamber directly at the upstream end of the ink passages.

Thus a (secondary) filter is created for each ink passage, so that when passing to the ink passages not only are any impurities removed from the ink but, in addition, any air bubbles in the ink are prevented from flowing in the ink passages. The possible mutual influence of the pressures in the ink passages is also greatly minimised by the closure provided by the filter with respect to the upstream inlets of the ink passages, and the filter therefore has an excellent restricting effect.

It should be noted that U.S. Pat. No. 4,364,067 discloses a print head having a substantially triangular base body or base plate, in cross-section, disposed with the apex towards the paper for printing and provided at the top with two ink inlets situated at the top ends of the oblique sides and communicating with an ink reservoir. Each of the inlets leads by internal passages to an ink distribution chamber to which there is connected a number of ducts disposed in the associated oblique side. These ducts converge with an arc in the plane of the associated oblique side towards a plurality of obliquely directed ink delivery nozzles. Grooves are formed in the upstream ends of the ducts by means of which the ink is filtered. A disadvantage of this construction is that the making of the grooves in the ducts requires considerable care.

In another feature of the present invention, the distribution chamber is disposed on the outside of the body and the ink passages are separated from the distribution chamber by means of a layer of material which is disposed on the body and in which filter passages are provided which correspond to the ink passages. Thus use is made of the chosen position of the secondary filter in order to simplify the body since there is no need for any passages between the inlet and the distribution chamber. In fact, the filter passages then form the inlet to the body.

In another feature thereof, the ink propulsion means comprises selectively actuatable piezo-electric elements, wherein an ink-tight layer, such as a suitable foil, extends between the piezo-electric elements and the ducts, wherein the ink-tight layer is formed as a unit with the layer of material provided with filter passages. Thus the filter can be mounted in one operation with the ink-tight layer for the ink propulsion means.

Preferably, the ink delivery nozzles are formed by the same ink-tight layer provided with a number of ink delivery passages in line with the ends of the ink passages and extending through the layer.

Advantageously, the body is provided with two opposite sides in which the ink passages provided with filter means are disposed in a comparable manner. If the ink passages over the path extending from the filter means to the ink delivery nozzles are formed as through ducts in the associated side and in the adjoining head end of the body and are covered by the same ink-tight layer, one and the same ink-tight layer can disposed (with a filter) around the body in order to perform a plurality of functions, simultaneously.

BRIEF DESCRIPTION OF THE DRAWINGS

The present invention will now be explained with reference to the exemplified embodiments illustrated in the accompanying drawings, wherein.

DETAILED DESCRIPTION OF THE INVENTION

Figure 2:
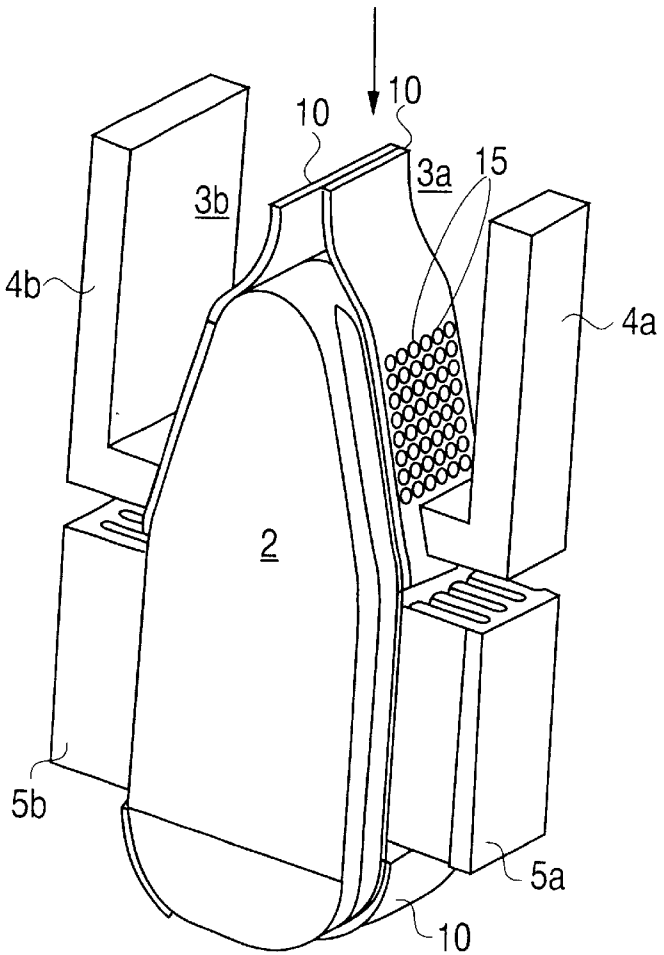
FIG. 2 is an oblique, perspective view from above the device shown in FIG. 1.
Figure 1:
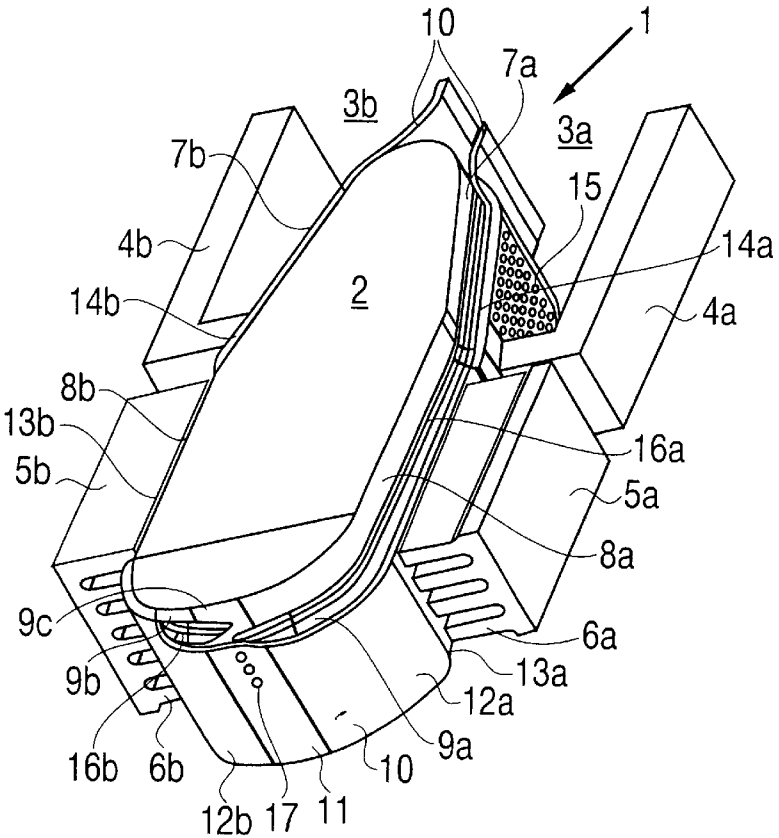
FIG. 1 is a bottom perspective view of one embodiment of the device according to the invention.

FIG. 1 shows a print head attachment 1 incorporating the elements according to the present invention. The print head attachment 1 comprises a base plate 2, for example of ceramic material, the top part of which is provided with two oblique sides 7*a*, 7*b*, two parallel sides 8*a* and 8*b*, and curved surfaces 9*a*, 9*b* which merge into a head surface 9*c*. Ink ducts 16*a*, 16*b* are milled in the sides or surfaces 7*a*, 8*a*, 9*a*, 9*c*, on the one hand, and 7*b*, 8*b*, 9*b* and 9*c*, on the other hand. These ducts are covered from the outside by a single foil 10, which is trained around the base plate 2 in the manner shown in the drawings, and fixed thereon. This foil may be a ceramic foil, a metal foil or a plastic film.

In the bottom part, the foil 10 is provided with a relatively thick portion 11, e.g. 0.1 mm thick, formed with through holes or nozzles 17 which are in line with the ends of the ducts 16*a*, 16*b*. Curved foil portions 12*a*, 12*b*, are located on either side of the foil portion 11 and cover the ducts 16*a*, 16*b* in the transition zone 9*a,* 9*b* to the sides 8*a,* 8*b.* The foil 10 is then continued as relatively thin portions 13*a,* 13*b,* e.g. 0.02 mm thick, which form a flexible top boundary of the ducts 16*a,* 16*b,* which are subject to the action of the legs 6*a,* 6*b* of piezo-electric elements or actuators 5*a,* 5*b.* The foil 10 then continues upwardly with portions 14*a,* 14*b,* which can also be relatively thin and in which filter passages 15 are provided, each in register with one of the ducts 16*a* or 16*b* respectively. A plurality of filter passages can be provided for each duct, e.g. a longitudinal row or an array or even an arbitrary screen provided with holes which are much smaller than the width of the ducts. The filter passages can be made by a laser machining of the foil and have a diameter of 0.01 mm, for example, but other techniques can be used, such as etching, electroforming and sandblasting. The filter passages 15 form the downstream boundary of ink distribution chambers 3*a,* 3*b,* which are also bounded by walls 4*a,* 4*b,* which here are shown purely diagrammatically, it being understood that they effectively surround the distribution chambers 3*a,* 3*b.* The drawing does not show the way in which the ink distribution chambers are connected to an ink source.

Figure 3:
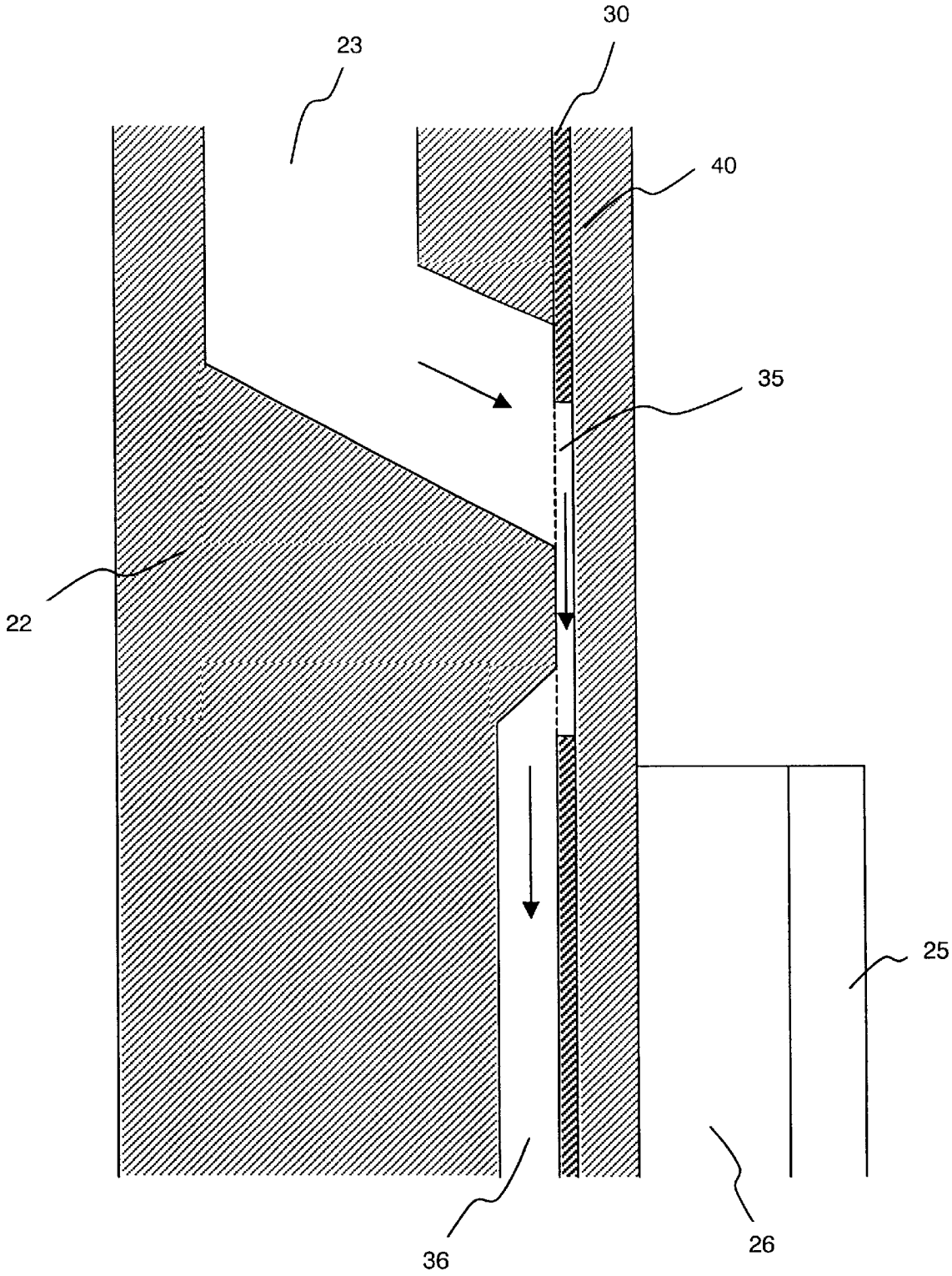
FIG. 3 is cross-section of another embodiment of the device according to the present invention.

FIG. 3 shows a printhead attachment 21 which comprises a base plate 22, for example of ceramic material, provided with ink ducts 36 milled in a side of the surface of the base plate, as well as one or more ink distribution chambers 23, which discharge into the same surface of the base plate.

The filter means between the ink distribution chamber and the upstream end of the ink ducts come about by covering said surface of the base plate with a foil 30, which comprises relatively large openings 35, for example, round openings with a diameter of 1 mm. An opening 35 forms an overlap with the ink distribution chamber and the upstream end of one or more of the ink ducts. By covering this foil, which for example is constituted of metal or plastic, with a continuous foil 40, a narrow passage with a width equal to the thickness of the foil (for example 0.01 mm), arises between the ink distribution chamber and the connected ink ducts.

The ink flows through the passage in a direction indicated by arrows in FIG. 3. The foils 30 and 40 are continued to form a flexible top boundary of the ink ducts, and are subjected to the action of the legs 26 of a piezo-electric element 25.

An advantage of this embodiment is that the ink distribution chamber as well as the ink ducts can be incorporated in the same base plate, without the need for physically separating them to insert the filter means. The resulting shape of the filter passages and surrounding cavities doesn't allow air bubbles to accumulate near or in the filter means. Another advantage is that the narrow passages can be created by introducing relatively large openings, which are easy to produce, in the foil 30, since the width of the passage in the direction of the ink flow is defined only by the thickness of the foil. An important advantage of the large openings is that clogging of the filter passages is substantially prevented, since, in a direction perpendicular to the ink flow, the width of the passages can be as large as the diameter of the opening 35.

In another embodiment of a device according to the invention, one thicker foil is used in stead of two separate foils 30 and 40. By milling, or in any other way introducing a recess into the surface of the foil, a narrow passage of the same shape can be formed between the ink distribution chamber and the ink ducts. An additional advantage of this embodiment is that less surfaces have to be connected with each other.

In a still further embodiment, one foil is used to cover the side of the base plate. Then, by removing a thin slice of material of the base plate (for example 0.01 mm thick) between the ink distribution chamber and the upstream ends of one or more ink ducts, a narrow passage can again be produced when the base plate is covered by a continuous foil. An advantage of this embodiment is that there is no need for introducing a recess in the foil.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A device for delivering ink to a substrate comprising a body member, an ink distribution chamber, a plurality of ink delivery nozzles, a plurality of ink passages formed in a side of said body member for delivering the ink from the ink distribution chamber to the ink delivery nozzles, the ink passages being formed, at least partially, as grooves in said side of the body member, each of the grooves having one end extended toward the ink delivery nozzle and the other end extended within the ink distribution chamber, and a filter member for filtering the ink entering the ink passages, said filter element being disposed over said side of the body member covering at least the elongated portion of the grooves extended within the distribution chamber.

2. The device according to claim 1, wherein the distribution chamber is disposed on the outside of the body member and the ink passages are separated from the distribution chamber by the filter element.

3. The device according to claim 2, wherein the filter element comprises a layer of material, which defines filter passages in the filter element, and correspondingly the ink passages.

4. The device according to claim 3, which further comprises ink propulsion means located at said ink passages for selectively propelling ink through said ink passages to the ink delivery nozzles, the ink propulsion means including actuatable piezo-electric elements, wherein an ink-tight layer is made of foil, extends between the piezo-electric elements and the ink passages, said ink-tight layer being formed as a unit with the filter element.

5. The device according to claim 4, wherein the ink delivery nozzles are formed by the same ink tight layer.

6. The device according to claim 4, wherein the ink passages are formed as through ducts in said side of the body member, wherein the ink passages are covered by said ink tight layer.

7. A printer provided with the device for delivering ink to a substrate as defined in claim 1.

* * * * *